US011213061B2

(12) United States Patent
Tseng

(10) Patent No.: US 11,213,061 B2
(45) Date of Patent: Jan. 4, 2022

(54) DEVICE FOR REFILLING VAPE SOLUTION

(71) Applicant: Po-Chiao Tseng, Taichung (TW)

(72) Inventor: Po-Chiao Tseng, Taichung (TW)

( * ) Notice: Subject to any disclaimer, the term of this patent is extended or adjusted under 35 U.S.C. 154(b) by 207 days.

(21) Appl. No.: 16/548,875

(22) Filed: Aug. 23, 2019

(65) Prior Publication Data

US 2021/0052012 A1 Feb. 25, 2021

(51) Int. Cl.
*A24B 15/16* (2020.01)
*A24B 15/167* (2020.01)
*B65B 3/04* (2006.01)

(52) U.S. Cl.
CPC ..... *A24B 15/167* (2016.11); *B65B 3/04* (2013.01)

(58) Field of Classification Search
CPC ..... A24B 15/167; B65B 3/04
USPC ..... 222/145.5, 145.6; 141/105, 107
See application file for complete search history.

(56) References Cited

U.S. PATENT DOCUMENTS 3,067,987 A * 12/1962 Ballou ..... B01F 15/00253 366/160.3
3,251,508 A * 5/1966 Borys ..... C10C 3/005 222/132
3,348,737 A * 10/1967 Yingst ..... B67D 1/0036 222/58
4,019,652 A * 4/1977 Suh ..... B29B 7/7615 222/1
4,547,128 A * 10/1985 Hayes ..... B01F 3/088 137/565.31
4,922,975 A * 5/1990 Polaschegg ..... A61J 3/002 141/104
5,499,745 A * 3/1996 Derian ..... B01F 15/047 222/136
5,697,132 A * 12/1997 DeCarbo, Sr. ..... A01N 1/00 222/145.5
6,045,007 A * 4/2000 Simmons ..... B67D 1/0035 141/100
6,186,193 B1 * 2/2001 Phallen ..... B65B 3/30 141/100
6,286,566 B1 * 9/2001 Cline ..... B01F 5/0615 141/18
6,516,245 B1 * 2/2003 Dirksing ..... A45D 40/00 700/233
6,824,012 B2 * 11/2004 Werner ..... B01F 15/00253 222/1
7,559,346 B2 * 7/2009 Herrick ..... A23C 9/133 141/102
7,694,850 B2 * 4/2010 Guerrero ..... B67D 1/07 222/1

(Continued)

*Primary Examiner* — Timothy L Maust
(74) *Attorney, Agent, or Firm* — Bruce Stone LLP; Joseph A. Bruce

(57) ABSTRACT

A device for refilling vape solution has a controller, a plurality of raw material containers, a mixer, a plurality of input controlling valves, and an output controlling valve. The plurality of raw material containers are respectively used for storing a kind of raw material. Each of the input controlling valves is used for connecting the mixer and one of the raw material containers and controlled by the controller to be opened or closed so as to selectively allow the raw material to be injected into the mixer. The output controlling valve is connected to the mixer and controlled by the controller to be opened or closed so as to output a product solution. The mixer is controlled by the controller to mix the raw materials therein so as to generate the product solution.

14 Claims, 2 Drawing Sheets

(56) References Cited

U.S. PATENT DOCUMENTS

| | | | | |
|---|---|---|---|---|
| 8,042,578 | B2 * | 10/2011 | Post | C09D 7/80 141/83 |
| 8,056,588 | B2 * | 11/2011 | Somerby | B01F 15/00136 141/105 |
| 8,333,301 | B2 * | 12/2012 | Majer | A47J 31/401 222/1 |
| 8,733,595 | B2 * | 5/2014 | Anselmino | B67D 1/0857 222/148 |
| 2005/0242119 | A1 * | 11/2005 | Matulis | A01C 23/008 222/145.6 |
| 2015/0028059 | A1 * | 1/2015 | O'Leary | B05C 17/00566 222/145.6 |
| 2015/0102062 | A1 * | 4/2015 | Mosimann | A47J 31/467 222/129.1 |
| 2016/0120118 | A1 * | 5/2016 | Bouten | A01M 7/0092 222/1 |
| 2018/0215488 | A1 * | 8/2018 | Sebastian | B01F 11/0014 |

* cited by examiner

DEVICE FOR REFILLING VAPE SOLUTION

TECHNICAL FIELD

The disclosure is related to a device for refilling solution, and particularly to a device for refilling vape solution.

BACKGROUND

There is a long history that people used tobacco products for increasing attention or calming effect. However, those tobacco products are addictive so that one may suffer from withdrawal symptoms when stopping using the tobacco products such as cigars or cigarettes after addicted. In addition, the convention way of using the tobacco products is burning it to generate nicotine which may increase attention or make people calm. It is inevitable that thousands of harming substances such as tar, hydrogen cyanide, acrolein, formaldehyde, acetaldehyde, and etc. Therefore, products such as vapes for generating vaporized low concentration nicotine are popular.

However, specified solution is needed for using the vape. The vape solutions are generally provided by manufacturers and the consumers cannot get his own customized products. This is an issue that both of consumers and manufacturers may feel inconvenient. The consumers may be unable to obtain his favorite vape solution while the manufacturers may lose potential customers.

SUMMARY

A device for refilling vape solution in one embodiment of the disclosure has a controller, a plurality of raw material containers, a mixer, a plurality of input controlling valves, and an output controlling valve. The plurality of raw material containers are respectively used for storing a kind of raw material. Each of the input controlling valves is used for connecting the mixer and one of the raw material containers and controlled by the controller to be opened or closed so as to selectively allow the raw material to be injected into the mixer. The output controlling valve is connected to the mixer and controlled by the controller to be opened or closed so as to output a product solution. The mixer is controlled by the controller to mix the raw materials therein so as to generate the product solution.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
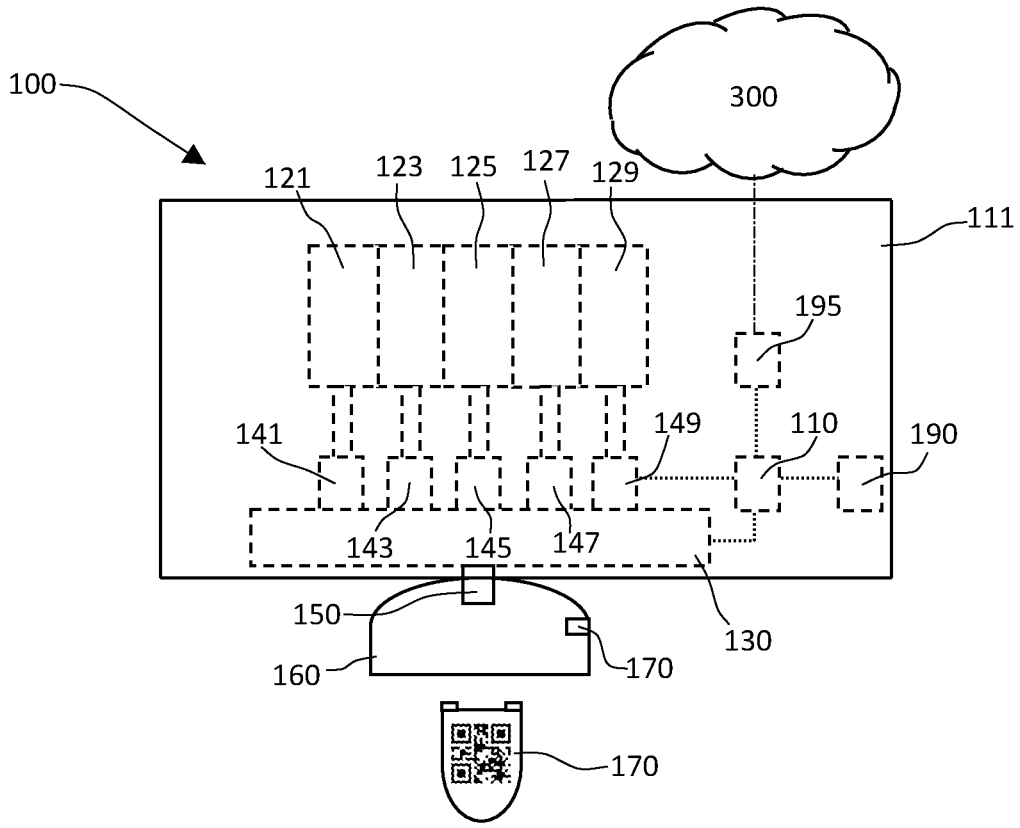
FIG. 1 is a schematic diagram of a device for refilling vape solution in one embodiment of the present disclosure.

Please refer to FIG. 1, which is a schematic diagram of a device for refilling vape solution in one embodiment of the present disclosure. As shown in FIG. 1, the device for refilling vape solution 100 has a controller 110, a plurality of raw material container 121~129, a mixer 130, a plurality of input controlling valve 141~149 and an output controlling valve 150. For example, the raw material container 121 is used for storing propylene glycol (PG), and the raw material container 123 is used for storing glycerol, the raw material container 125 is used for storing nicotine, the raw material container 127 and the raw material container 129 are used for storing essence. The aforementioned example utilizes five raw material containers, but the device for refilling vape solution may has fewer or more raw material containers. For example, the container may be used for storing Cannabidiol (CBD).

The input controlling valve 141 has one terminal connected to the raw material container 121 and the other terminal connected to the mixer 130. The input controlling valve 143 has one terminal connected to the raw material container 123 and the other terminal connected to the mixer 130. The input controlling valve 145 has one terminal connected to the raw material container 125 and the other terminal connected to the mixer 130. The input controlling valve 147 has one terminal connected to the raw material container 127 and the other terminal connected to the mixer 130. The input controlling valve 149 has one terminal connected to the raw material container 129 and the other terminal connected to the mixer 130. When the controller 110 makes the input controlling valve 141 opened, the propylene glycol in the raw material container 121 flows into the mixer 130 via the input controlling valve 141. In one embodiment, though each of the raw materials has its intrinsic flow speed, the intrinsic flow speed of on raw material is constant. The controller 110 controls the proportion of certain raw material among the product solution by controlling the duration of open of each input controlling valve. In another embodiment, when the controller 110 makes the input controlling valve 141 opened, the other input controlling valves are closed. Furthermore, the mixer 130 has a sensor for measuring the weight of the solution in the mixer 130. The controller 110 is also capable of communicating with the sensor of the mixer 130. Therefore, the controller 110 is capable of determining the weight of the raw material which is currently injected according to the variation of the weight of the solution in the mixer 130. In yet another embodiment, each raw material container has a corresponding sensor for measuring the weight or the volume of the raw material therein. The controller 110 is capable of communicating with those sensors so that the controller 110 is capable of determining the injection quantity of each raw material according to the variation of the raw material in each of the raw material containers so as to selectively open or close certain input controlling valve(s). In some embodiments, each raw material container has an optical scanner for obtaining information from a package of raw material, i.e. the model, the type, the weight and/or the volume of the packet of raw material.

Figure 2:
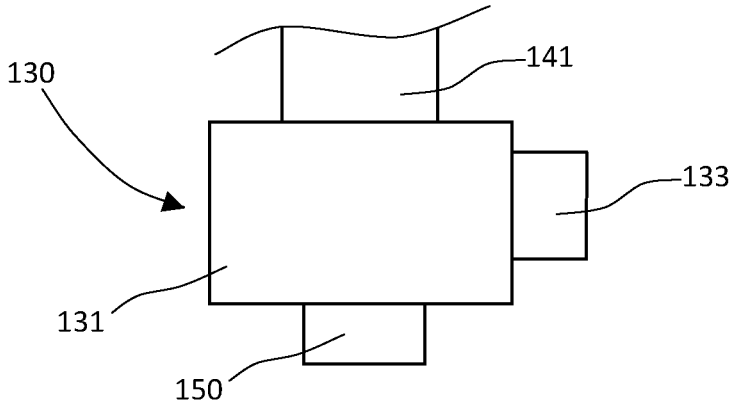
FIG. 2 is a structural schematic illustrating part of the mixer in one embodiment of the disclosure.

After all raw materials are injected into the mixer 130, the mixer 130 is controlled by the controller 110 to mix the raw materials therein so as to produce the product solution. In one embodiment, please refer to FIG. 2, which is a structural schematic illustrating part of the mixer in one embodiment of the disclosure. The mixer 130 has a solution container 131 and a heat pipe 133. The solution container 131 is connected to the input controlling valves 141~149. The heat pipe 133 is adjacent or surrounding the solution container 131 and controlled by the controller 110 to heat the solution container 131 so as to accelerate the mixing of the raw materials in the solution container 131.

Figure 3:
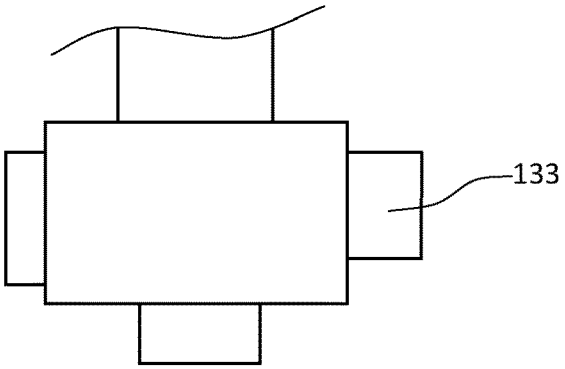
FIG. 3 is a structural schematic of the mixer in another embodiment of the disclosure.

In another embodiment, please refer to FIG. 3, which is a structural schematic of the mixer in another embodiment of the disclosure. The mixer 130 in this embodiment, compared with that in FIG. 2, further has a vibrator 135 connected to the solution container 131. The vibrator 135 is electrically connected to the controller 110 so that the controller 110 is capable of controlling the vibrator 135 to vibrate and make the solution container 131 vibrate to accelerate the mixing of the raw materials. The vibrator 135 is, for example but not limited to, a piezoelectric vibrator, a motor vibrator, or any other devices capable of generating vibration with frequency greater than 20 kHz.

Figure 4:
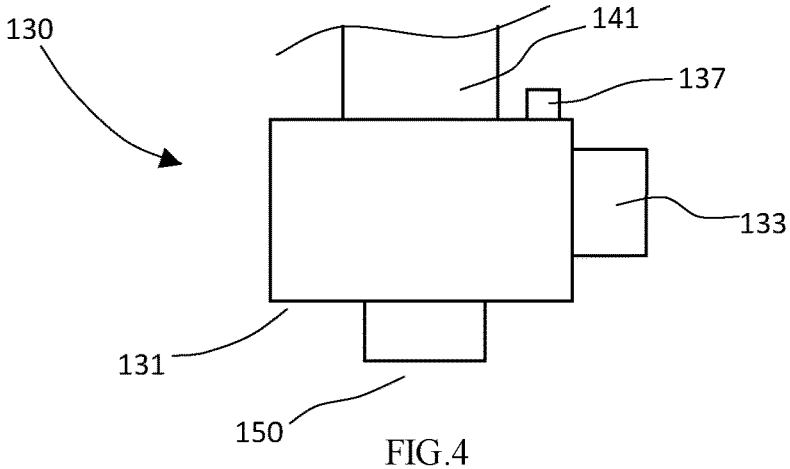
FIG. 4 is a structural schematic of the mixer in yet another embodiment of the disclosure.

In yet another embodiment, please refer to FIG. 4, which is a structural schematic of the mixer in yet another embodiment of the disclosure. The mixer 130 in this embodiment, compared with the mixer in FIG. 2, further has a compressor 137. The compressor 137 is, for example, an air pump controlled by the controller 110 for pumping air into the solution container 131 so as to increase the air pressure in the solution container 131.

Please go back to FIG. 1. The output controlling valve 150 has one terminal connected to the mixer 130 and the other terminal connected to the vessel stand 160. The output controlling valve 150 is controlled by the controller 110 to be opened or closed so as to output the product solution. The vessel stand 160 is used for connecting to a vessel 200 which is to be refilled. In one embodiment, the device 100 further has an optical scanner 170 for scanning the bar code on the vessel 200. The bar code may be one dimensional bar code, two dimensional bar code or other adequate bar code for indicating the model of the vessel 200. In other embodiments, the vessel 200 may have a built-in chip and the controller 110 detects the model of the vessel 200 by communicating with the built-in chip when the vessel stand 160 is connected to the vessel 200. In some embodiments, the communication may be made with near field communication (NFC) or other wireless communication methods.

In one embodiment, there is a bar code on the refilling pack of the raw material sold by the manufacturer. When the user or the owner of the device 100 replaces or refills certain raw material container, he may use the optical scanner 170 to scan the bar code on the refilling pack so as to obtain the information regarding to the raw material in the refilling pack such as manufacturer, volume, type, and etc. With the sensor in each of the raw material container in aforementioned embodiment, the controller 110 is capable of determining the quantity of the raw materials in all raw material containers and determining whether or not it is necessary to refill the raw material(s). When it is determined by the controller 110 that certain raw material container needs to be refilled, the controller 110 may inform the user or the owner by the control panel 111.

Figure 5:
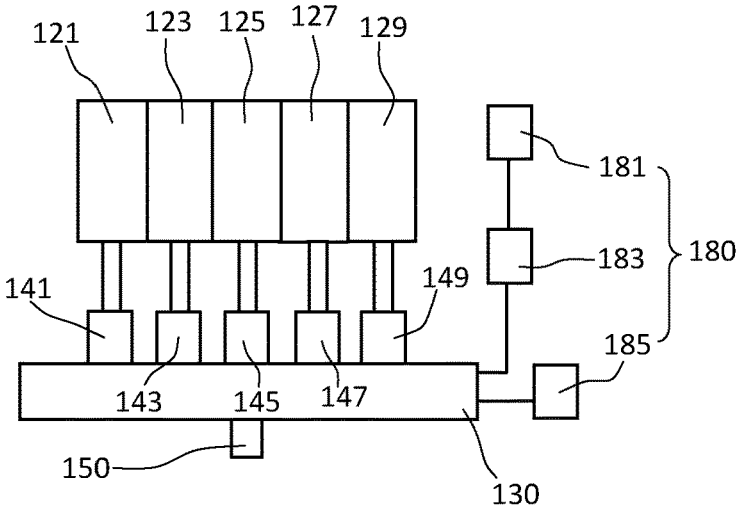
FIG. 5 is a functional block diagram of the device for refilling vape solution in one embodiment of the disclosure.

In one embodiment, please refer to FIG. 5, which is a functional block diagram of the device for refilling vape solution in one embodiment of the disclosure. The device, in addition to the components in FIG. 1, further has a cleaning module 180 connected to the mixer 130. The cleaning module 180 is controlled by the controller 110 for cleaning the mixer 130. For example, the cleaning module 180 may have a detergent container 181, detergent controlling valve 183 and water-in valve 185. When the mixer 130 is needed to be cleaned, the controller 110 closes all input controlling valves and the output controlling valve. The controller 110 also open the detergent controlling valve 183 for a period of time so as to inject predetermined quantity of detergent into the solution container 131. In one embodiment, the controller 110 controls the vibrator 135 of the mixer 130 to vibrate for a predetermined period of time so as to thoroughly clean the inner wall of the solution container 131. Then, the controller 110 open the water-in valve 185 and the output controlling valve 150 to flush out all the detergent in the solution container 131.

In one embodiment, after the user order a cleaning procedure via the control panel 111, the controller 110 controls the cleaning module 180 to perform the cleaning procedure. In another embodiment, the scanner is unable to detect the vessel 200 after the vessel 200 is removed from the vessel stand 160 by the user. Therefore, the controller 110 is able to determine when the vessel 200 is removed and control the cleaning module 180 to start the cleaning procedure.

Practically, if the device 100 is for commercial purpose or is installed in a public are, the preference varies from one user to another. In order to prevent the use by the influences of the previous recipe, the cleaning procedure is automatically performed after every use of the device 100. If the device 100 is for personal use, there is no aforementioned issue and the user may determine when to perform the cleaning procedure. In one embodiment, the raw material containers 121~129, the components of the mixer 130, the components of the cleaning module 180, and the vessel stand 160 are removable. Therefore, the owner of the device 100 may arbitrarily remove those removable components for cleaning or replacement purpose.

Please go back to FIG. 1. In another embodiment of the disclosure, the device 100 further has a storage medium 190 electrically connected to the controller 110. The controller 110 organizes the ratios of the raw materials as a piece of historic data and saves it in the storage medium 190 after the user uses the device 100. In one embodiment, the controller 110 controls the input controlling valves 141~149 according to the parameter(s) received and the recipe model in the storage medium 190. For example, if the user prefers high concentration of nicotine, the proportions of propylene glycol, glycerol, and essence should be reduced. If the user prefers throat sensation, the controller 110 increases the proportion of propylene glycol. If the user prefer the atmosphere of smoke, the controller 110 may increase the proportion of glycerol.

In one embodiment, the storage medium 190 stores a plurality of recipe models and each model is corresponding to certain model of vape. Practically, a vape may be an electric vape or a mechanic vape according to its working mechanism. The proportion of water in the product solution is restricted for mechanic vape because of the danger of short circuit thereof. Therefore, the recipe model for a mechanic vape may be different from the recipe model for an electric vape. In one embodiment, how the mixer 130 mixes raw materials, such as the requirement of time, temperature, and pressure, may vary according to the parameter(s) and recipe models. Therefore, the controller 110 may also control the heat pipe 133, the vibrator 135, and/or the compressor 137 according to the parameter and the recipe model.

In another embodiment, the device 100 as shown in FIG. 1 may further have a network hub 195 electrically connected to the controller 110. The network hub 195 is, for example but not limited to, a device suitable for Bluetooth standard, Wi-Fi standard, Zigbee standard, Wireless LAN, Virtual LAN, coaxial cable network, optical fiber network, Ethernet standard, or other communication standard. The controller 110 is capable of sending at least one piece of historic data to a server 300 in the network. Practically, the manufacturer of the vape solution is capable of analyzing the data in the server 300 so as to obtain one or more recipes which has higher potential than other recipes. In yet another embodiment, the manufacturer may share in social networks a mainstream recipe or a whole new recipe obtained from the analysis of the date in the server 300 for the sake of advertisement. In another embodiment, the controller 110 is capable of obtaining one or more recipe models from the server 300 via the network hub 195.

What is claimed is:

1. A device for refilling vape solution, wherein the device comprises:

a controller;

a plurality of raw material containers for storing raw materials;

a mixer;

a plurality of input controlling valves, each of the input controlling valves used for connecting the mixer and one of the plurality of raw material containers and controlled by the controller to be opened or closed so as to selectively inject the raw material in the connected raw material container into the mixer;

an output controlling valve connected to the mixer and controlled by the controller so as to output product solution; and a storage medium electrically connected to the controller;

wherein the mixer is controlled by the controller to mix the raw material therein so as to generate the product solution, the controller controls the plurality of input controlling valves according to at least one parameter received and at least one model in the storage medium, and the controller further controls the mixer according to the at least one parameter and the at least one model to generate the product solution;

wherein the at least one parameter and the at least one model is freely selectable by a user.

2. The device in claim 1, wherein the mixer comprises:

a solution container connected to the input controlling valves; and a heat pipe adjacent to the solution container and controlled by the controller.

3. The device in claim 2, wherein the mixer further comprises a vibrator controlled by the controller.

4. The device in claim 3, wherein the mixer further comprises a compressor connected to the solution container and controlled by the controller.

5. The device in claim 2, wherein the mixer further comprises a compressor connected to the solution container and controlled by the controller.

6. The device in claim 1, further comprising a scanner for scanning a vessel to be refilled.

7. The device in claim 1, further comprising a cleaning module connected to the mixer and controlled by the controller for cleaning the mixer.

8. The device in claim 7, further comprising a network hub electrically connected to the controller, wherein the controller sends a piece of historic data in the storage medium to a server via the network hub.

9. The device in claim 8, wherein the controller downloads a plurality of pieces of data from the server via the network hub.

10. The device in claim 1, wherein each raw material container comprises an optical scanner for obtaining information from a package of raw material.

11. The device in claim 1, wherein each raw material container comprises a corresponding sensor for measuring a weight or a volume of the raw material therein, the controller communicates with each sensor to determine an injection quantity of each raw material according to a variation of each of the raw materials in each of the raw material containers.

12. The device in claim 1, wherein the mixer comprises a sensor for measuring a weight of a solution in the mixer, the controller communicates with the sensor of the mixer to determine a weight of each of the raw materials which is currently injected according to a variation of the weight of the solution in the mixer.

13. The device in claim 11, wherein the server analyzes the piece of historic data to generate a new recipe model and a mainstream recipe model, and the recipe models are published to a social network via the server for serving advertisements.

14. A device for refilling vape solution, wherein the device comprises:

a controller;

a plurality of raw material containers for storing raw materials;

a mixer;

a plurality of input controlling valves, each of the input controlling valves used for connecting the mixer and one of the plurality of raw material containers and controlled by the controller to be opened or closed so as to selectively inject the raw material in the connected raw material container into the mixer;

an output controlling valve connected to the mixer and controlled by the controller so as to output product solution;

a storage medium electrically connected to the controller; and a network hub electrically connected to the controller;

wherein the controller organizes a ratio of each of the raw materials as a piece of historic data and saves it in the storage medium, the controller sends the piece of historic data in the storage medium to a server via the network hub, the server analyzes the piece of historic data to obtain at least one recipe model, the controller downloads the at least one recipe models from the server via the network hub;

wherein the mixer is controlled by the controller to mix the raw material therein so as to generate the product solution, the controller controls the plurality of input controlling valves according to the recipe model, and the controller further controls the mixer according to the recipe model to generate the product solution.

* * * * *